US009061520B2

(12) United States Patent
Matsusaki et al.

(10) Patent No.: US 9,061,520 B2
(45) Date of Patent: Jun. 23, 2015

(54) THERMAL HEAD AND THERMAL PRINTER INCLUDING THE SAME

(75) Inventors: Yuuki Matsusaki, Kirishima (JP); Kouji Ochi, Kirishima (JP); Tadashi Mitsuoka, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 13/981,633

(22) PCT Filed: Jan. 25, 2012

(86) PCT No.: PCT/JP2012/051522

§ 371 (c)(1),
(2), (4) Date: Jul. 25, 2013

(87) PCT Pub. No.: WO2012/102298

PCT Pub. Date: Aug. 2, 2012

(65) Prior Publication Data

US 2013/0307916 A1 Nov. 21, 2013

(30) Foreign Application Priority Data

Jan. 25, 2011 (JP) ..... 2011-013172

(51) Int. Cl.
*B41J 2/335* (2006.01)

(52) U.S. Cl.
CPC ..... *B41J 2/3353* (2013.01); *B41J 2/335* (2013.01); *B41J 2/3354* (2013.01); *B41J 2/33545* (2013.01); *B41J 2/3355* (2013.01); *B41J 2/3357* (2013.01)

(58) Field of Classification Search
USPC ..... 347/200, 202, 203, 204, 206
See application file for complete search history.

(56) References Cited

FOREIGN PATENT DOCUMENTS

| | | | |
|---|---|---|---|
| JP | 2008-230126 | A | 10/2008 |
| JP | 2009-131994 | A | 6/2009 |
| JP | 2010-247470 | A | 11/2010 |

OTHER PUBLICATIONS

Computer-generated translation of JP 2010-247470, published on Nov. 2010.*
Computer-generated translation of JP 2008-230126, published on Oct. 2008.*
Computer-generated translation of JP 2009-131994, published on Jun. 2009.*

* cited by examiner

*Primary Examiner* — Huan Tran
(74) *Attorney, Agent, or Firm* — Volpe and Koenig, P.C.

(57) ABSTRACT

A thermal head includes a substrate, a glass-made thermal storage layer disposed on one main surface of the substrate so as to extend to an edge of the substrate; electrodes disposed on or above the thermal storage layer apart from the edge of the substrate; heat-generating resistors disposed above the thermal storage layer apart from the edge of the substrate, the heat-generating resistors being connected to the electrodes; and a first covering layer disposed on or above the electrodes and the heat-generating resistors. The first covering layer extends from atop the electrodes and the heat-generating resistors toward atop the thermal storage layer on the edge of the substrate, and a protection film is disposed on or above the first covering layer disposed on or above the electrodes and the heat-generating resistors and an edge of the protection film is not disposed above the edge of the substrate.

20 Claims, 9 Drawing Sheets

THERMAL HEAD AND THERMAL PRINTER INCLUDING THE SAME

TECHNICAL FIELD

The present invention relates to a thermal head and a thermal printer including the same.

BACKGROUND ART

Various types of thermal heads have been heretofore proposed as printing devices for a facsimile, a video printer or the like. For example, a thermal head described in Patent Literature 1 includes a substrate, a thermal storage layer disposed on one main surface of the substrate so as to extend to an edge of the substrate, the thermal storage layer being made of glass, electrodes disposed above the thermal storage layer apart from the edge of the substrate, heat-generating resistors connected to the electrodes, a covering layer disposed on the electrodes and the heat-generating resistor and a protection film disposed on the covering layer (for example, refer to Patent Literature 1).

CITATION LIST

Patent Literature

Patent Literature 1: Japanese Unexamined Patent Publication JP-A 2009-131994

SUMMARY OF INVENTION

Technical Problem

In the above thermal head, there is a case where a crack occurs in the thermal storage layer made of glass, and there is a possibility that the crack occurring in the thermal storage layer further extends and penetrates upper and lower surfaces of the thermal storage layer when the thermal head is driven. Accordingly, a chip may occur in the thermal storage layer and the electrodes and the heat-generating resistor may deteriorate.

Solution to Problem

A thermal head according to an embodiment of the invention includes a substrate; a thermal storage layer disposed on one main surface of the substrate so as to extend to an edge of the substrate, the thermal storage layer being formed of glass; electrodes disposed on or above the thermal storage layer apart from the edge of the substrate; heat-generating resistors disposed above the thermal storage layer apart from the edge of the substrate, the heat-generating resistors being connected to the electrodes; a first covering layer disposed on or above the electrodes and the heat-generating resistors; and a protection film disposed on or above the first covering layer, the first covering layer extending from atop the electrodes and the heat-generating resistors toward atop the thermal storage layer on the edge of the substrate, the protection film being disposed on or above the first covering layer disposed on or above the electrodes and the heat-generating resistors and an edge of the protection film being not disposed above the edge of the substrate.

A thermal printer according to an embodiment of the invention includes the thermal head mentioned above; a conveyance mechanism that conveys a recording medium on a plurality of heat-generating portions; and a platen roller that presses the recording medium on the plurality of heat-generating portions.

Advantageous Effects of Invention

According to the invention, possibility of crack extension can be reduced even if any crack occurs in the thermal storage layer.

DESCRIPTION OF EMBODIMENTS

Figure 1:
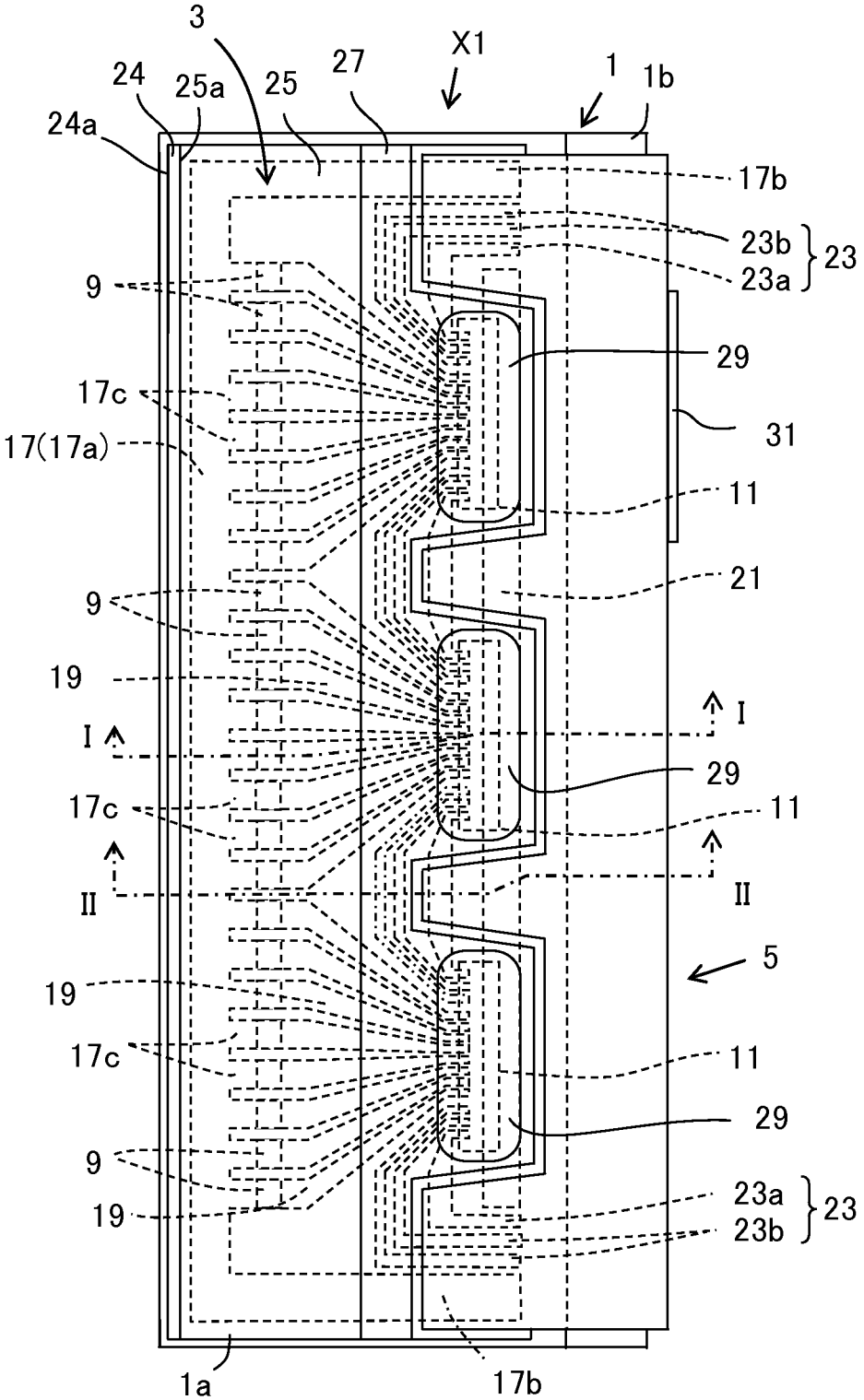
FIG. 1 is a plan view showing a thermal head according to one embodiment of the invention.
Figure 2:
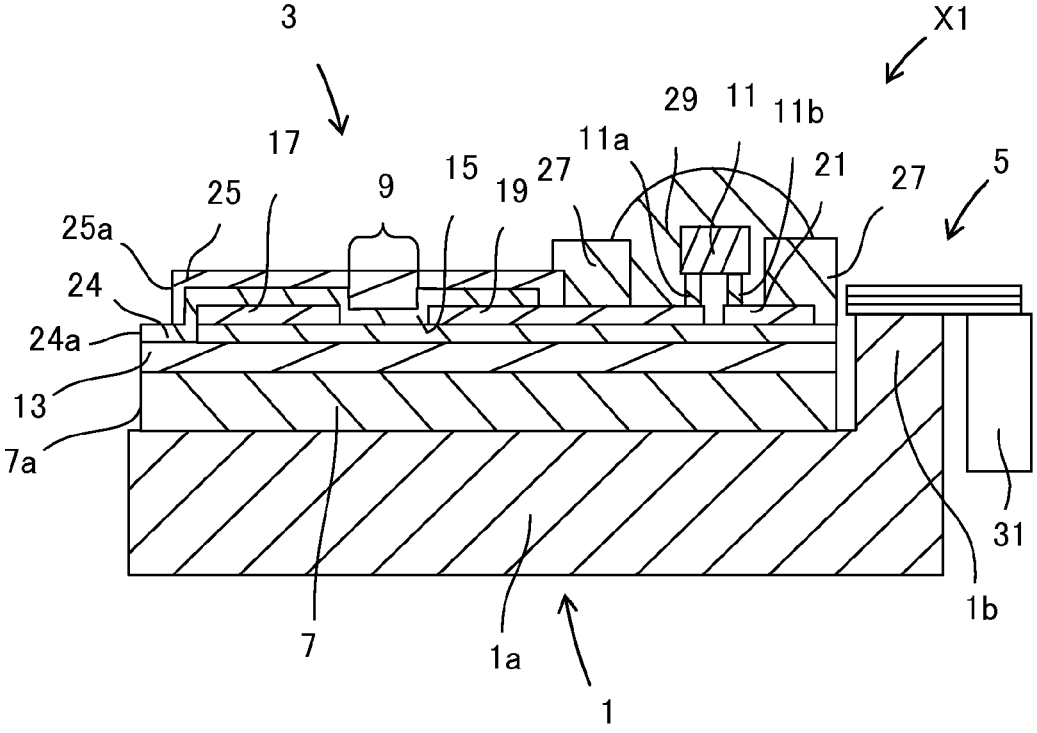
FIG. 2 is a cross-sectional view of the thermal head taken along the line I-I of FIG. 1.
Figure 3:
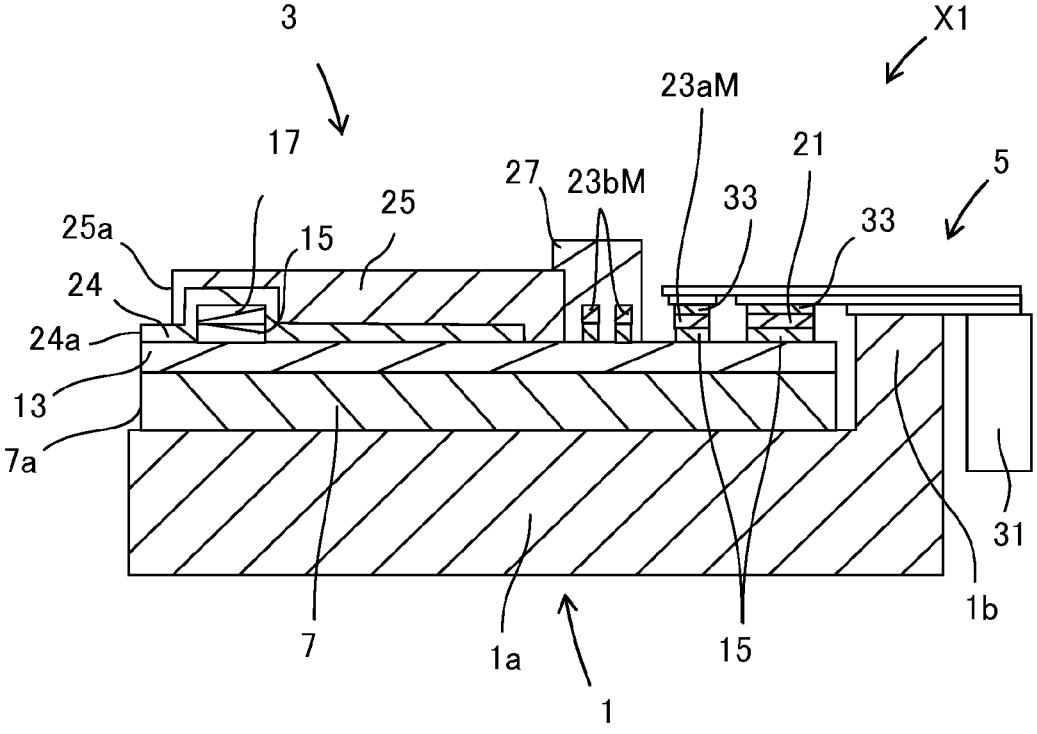
FIG. 3 is a cross-sectional view of the thermal head taken along the line II-II of FIG. 1.

Hereinafter, a thermal head according to one embodiment of the invention will be described with reference to the drawings. As shown in FIGS. 1 to 3, a thermal head X1 of the present embodiment includes a heatsink 1, a head base 3 arranged on the heatsink 1 and a flexible printed circuit board 5 (hereinafter referred to as an FPC 5) connected to the head base 3.

The heatsink 1 is made of a metal material such as copper or aluminum, including a bed plate portion 1*a* having a rectangular shape in a plan view and a protruding portion 1*b* extending along one long side of the bed plate portion 1*a*. As shown in FIG. 2, the head base 3 is bonded to an upper surface of the bed plate portion 1*a* other than the protruding portion 1*b* by a double-faced tape, adhesives or the like (not shown). The FPC 5 is bonded to the protruding portion 1*b* by the double-faced tape, adhesives or the like (not shown). Moreover, the heatsink 1 has a function of radiating part of heat not contributing to printing in heat generated at heat-generating portions 9 of the head base 3 as described later.

Figure 4:
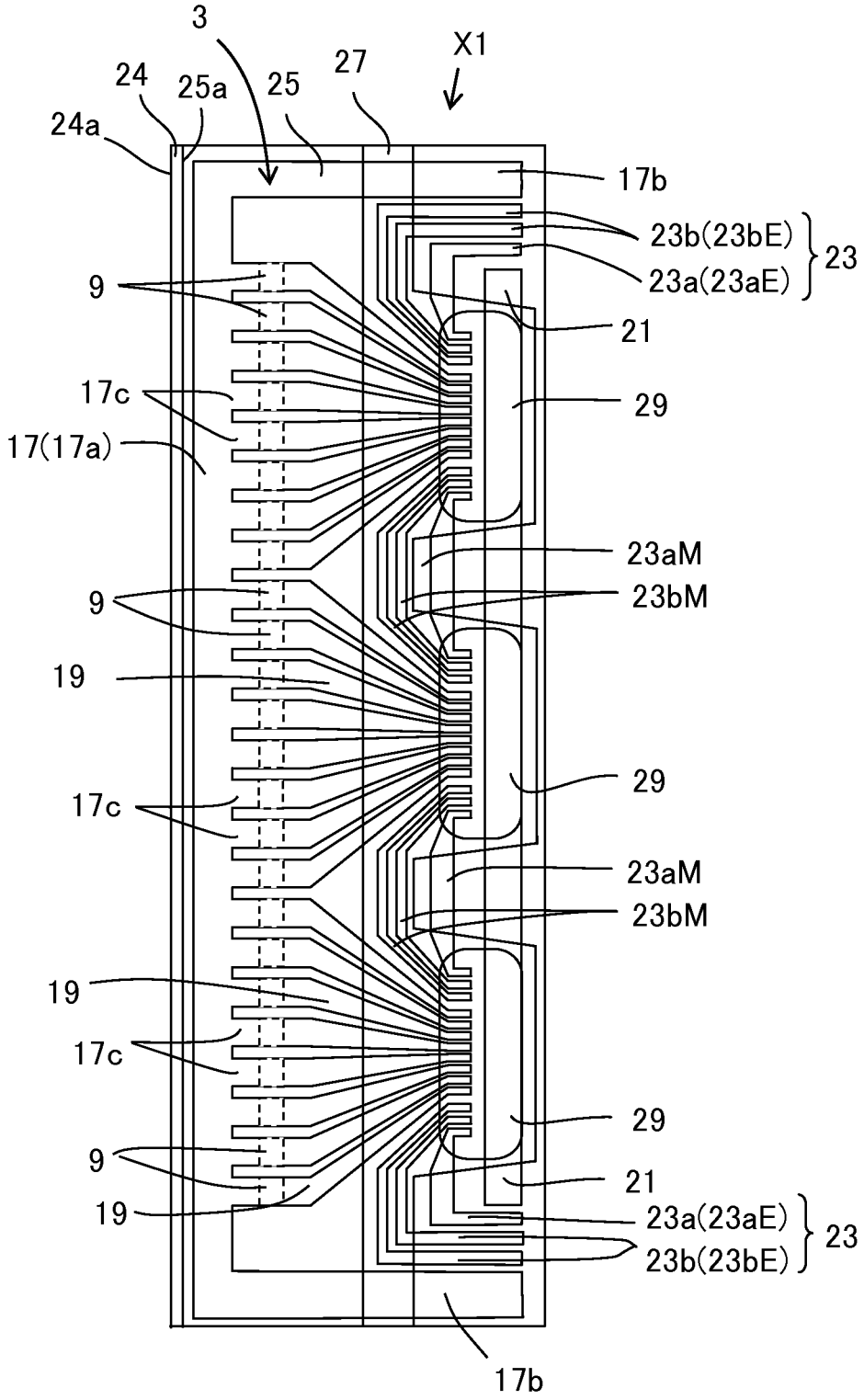
FIG. 4 is a plan view of a head base in the thermal head of FIG. 1.
Figure 5:
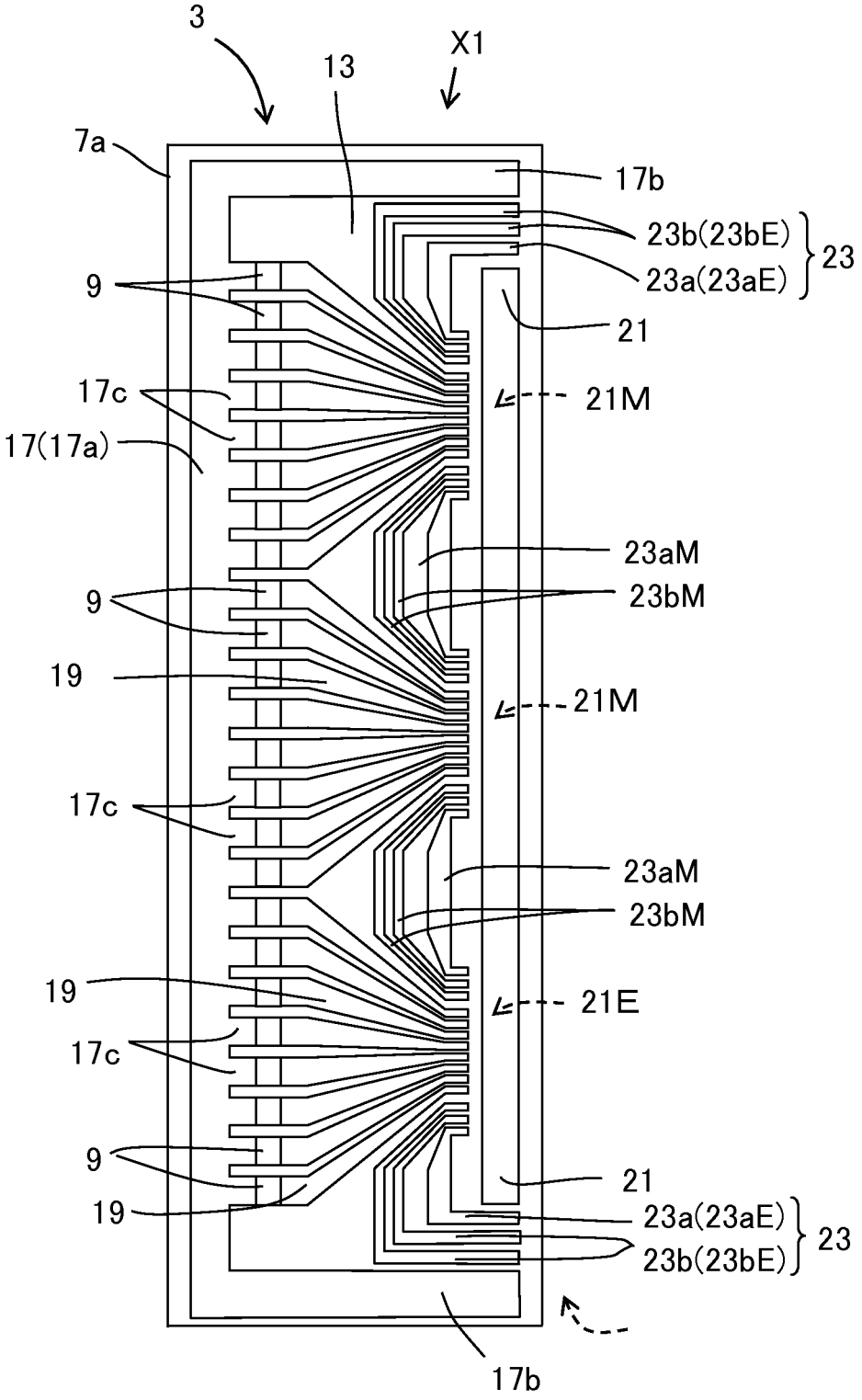
FIG. 5 is a plan view of the head base of FIG. 4 in which a first protection film, a second protection film, a first covering layer, driver ICs and a covering member are not shown.

As shown in FIGS. 1 to 5, the head base 3 includes a substrate 7 having a rectangular shape in a plan view, a plurality of heat-generating portions 9 disposed above the substrate 7 and arranged along a longitudinal direction of the substrate 7 and a plurality of driver ICs 11 arranged side by side on the substrate 7 along the arrangement direction of the heat-generating portions 9. FIG. 4 is a plan view of the head base 3. FIG. 5 is a plan view of the head base 3 in which a later-described first protection film 25, a second protection film 28, a first covering layer 24, the driver ICs 11 and a covering member 29 are not shown.

The substrate 7 has a rectangular shape, including one main surface, the other main surface arranged on the opposite side of one main surface and a plurality of side surfaces connecting one main surface and the other main surface. An edge 7*a* of the substrate 7 is formed at a ridgeline portion formed by one main surface and the side surfaces. The substrate 7 is made of an electrically insulating material such as alumina ceramics or a semiconductor material such as monocrystalline silicon.

As shown in FIGS. 2, 3 and 5, a thermal storage layer 13 is disposed on an upper surface of the substrate 7 over the entire upper surface of the substrate 7. In the present embodiment, the upper surface of the substrate 7 corresponds to one main surface in the invention. The thermal storage layer 13 is made of, for example, glass having low thermal conductivity and is capable of temporarily accumulating part of heat generated in the heat-generating portions 9, therefore, the thermal storage layer 13 functions so as to shorten the time necessary for increasing the temperature of the heat-generating portions 9 to increase thermal response characteristics of the thermal head X1. The thermal storage layer 13 is formed by, for example, applying a given glass paste obtained by mixing a suitable organic solvent into glass powder on the upper surface of the substrate 7 by using a well-known screen printing or the like and firing the mixture at a high temperature. Examples of the glass for forming the thermal storage layer 13 include glass containing $SiO_2$, $Al_2O_3$, CaO and BaO, glass containing $SiO_2$, $Al_3O_3$ and PbO, glass containing $SiO_2$, $Al_2O_3$ and BaO, and glass containing $SiO_2$, $B_2O_3$, PbO, $Al_2O_3$, CaO and MgO. A Vickers hardness of these glasses is approximately 500 to 900 HV.

An electric resistor layer 15 is disposed above the upper surface of the thermal storage layer 13. The electric resistor layer 15 is interposed between the thermal storage layer 13 and a later-descried common electrode wiring 17, individual electrode wirings 19, a ground electrode wiring 21 and IC control wirings 23. The electric resistor layer 15 has regions having the same shapes as the individual electrode wirings 19, the common electrode wiring 17, the ground electrode wiring 21 and the IC control wirings 23 in a plan view (hereinafter referred to as interposed regions) as well as a plurality of regions exposed from between the common electrode 17 and the individual electrode wirings 19 as shown in FIG. 5 (hereinafter referred to as exposed regions). Note that the interposed regions of the electric resistor layer 15 are hidden by the common electrode wiring 17, the individual electrode wirings 19, the ground electrode wiring 21 and the IC control electrode wirings 23 in FIG. 5.

The respective exposed regions of the electric resistor layer 15 form the heat-generating portions 9. Then, the plurality of heat-generating portions 9 are arranged in a line on the thermal storage layer 13 as shown in FIGS. 2 and 5. The plurality of heat-generating portions 9 are shown in a simple manner for convenience of description in FIGS. 1, 4 and 5, which are arranged in a density of, for example, 180 to 2400 dpi (dot per inch). In the present embodiment, the exposed regions of the electric resister layer 15 to be the heat-generating portions 9 correspond to electric resistors of the invention.

The electric resistor layer 15 is made of a material having relatively high electric resistance such as a TaN-based, a TaSiO-based, a TaSiNO-based, a TiSiO-based, a TiSiCO-based or a NbSiO-based material. Accordingly, when a voltage is applied between the later-described common electrode wiring 17 and the individual electrode wirings 19, and the voltage is applied to the heat-generating portions 9, the heat-generating portions 9 generate heat due to Joule heat.

Figure 6:
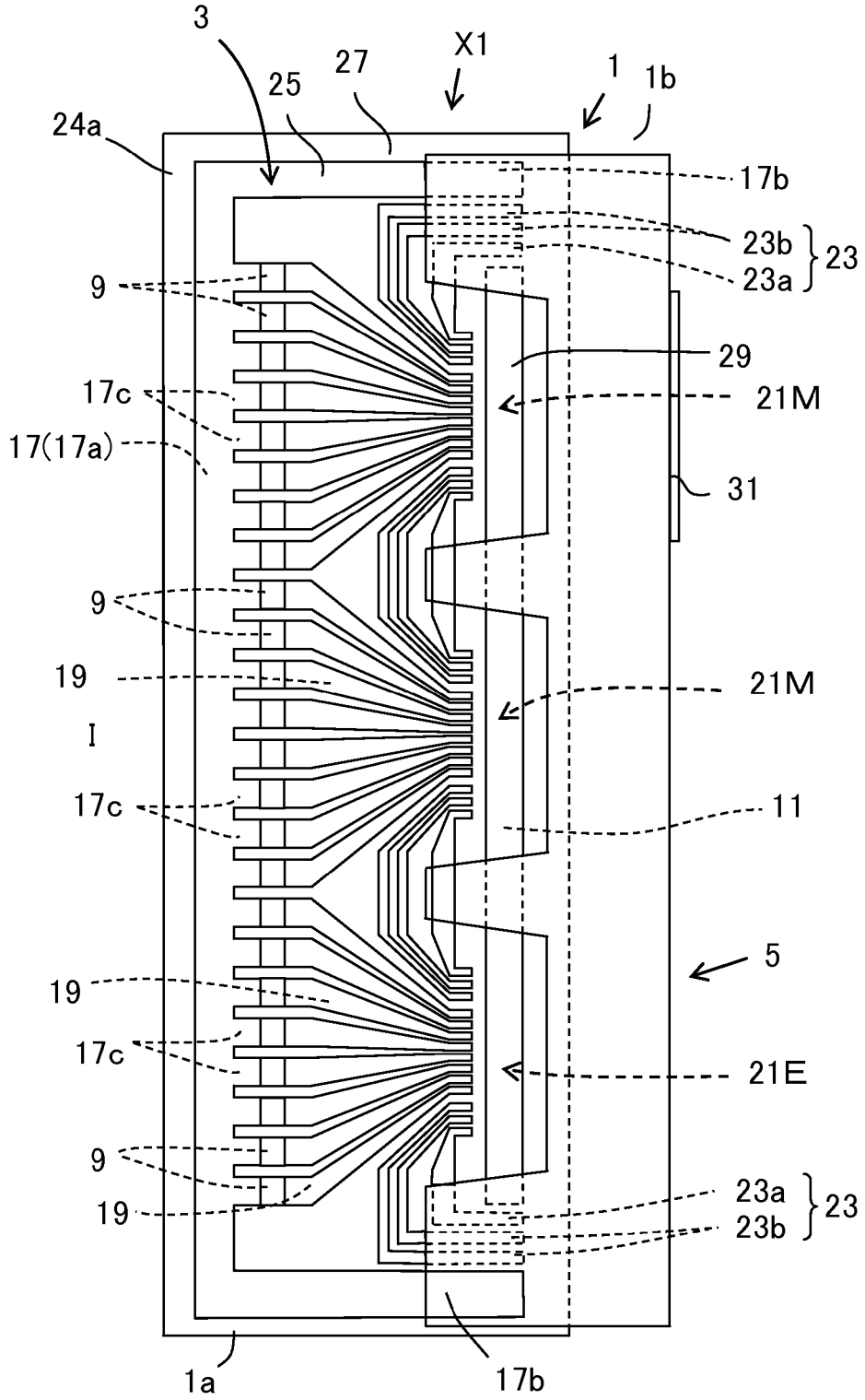
FIG. 6 is a plan view showing a state where an FPC is connected to the head base in which the first protection film, the second protection film, the first covering layer and the covering member are not shown.

As shown in FIGS. 1 to 6, the common electrode wiring 17, individual electrode wirings 19, the ground electrode wiring 21 and the IC control wirings 23 are disposed on an upper surface of the electric resistor layer 15. These common electrode wiring 17, the individual electrode wirings 19, the ground electrode wiring 21 and the IC control wirings 23 are made of a material having conductivity, which is, for example, at least one metal selected from aluminum, gold, silver and copper or an alloy including these metals. FIG. 6 is a plan view showing a state where the FPC 5 is connected to the head base 3 in which the later-described first protection film 25, the second protection film 28, the first covering layer 24 and the covering member 29 are not shown.

As shown in FIG. 5, the common electrode 17 has a main wiring portion 17*a* extending along one long side of the substrate 7, two sub-wiring portions 17*b* respectively extending one and the other short sides of the substrate 7, one end portions of which are connected to the main wiring portion 17*a*, a plurality of lead portions 17*c* extending toward the respective heat-generating portions 9 from the main wiring portion 17*a*. Then, the other end portions of the sub-wiring portions 17*b* are connected to the FPC 5 as well as tip portions of the lead portions 17*c* are connected to the heat-generating portions 9 as shown in FIG. 6. Accordingly, the FPC 5 and the heat-generating portions 9 are electrically connected.

The individual electrode wirings 19 extend between the respective heat-generating portions 9 and the driver ICs 11 to connect them to each other as shown in FIGS. 2 and 6. In more detail, the individual electrode wirings 19 divide the plurality of heat-generating portions 9 into a plurality of groups, and electrically connect the heat-generating portions 9 in the respective groups to the driver ICs 11 provided so as to correspond to respective groups.

The main wiring portion 17*a* of the common electrode wiring 17 is disposed above the thermal storage layer 13 apart from the edge 7*a* of the substrate 7 as shown in FIG. 6. That is, the common electrode wiring 17 and the individual electrode wirings 19 are disposed above the thermal storage layer 13 apart from the edge 7*a* of the substrate 7. In the present embodiment, the common electrode wirings 17 and the individual electrode wirings 19 correspond to electrodes in the invention.

The ground electrode wiring 21 extends along the arrangement direction of the heat-generating portions 9 in a band shape in the vicinity of the other long side of the substrate 7 as shown in FIG. 5. On the ground electrode wiring 21, the FPC 5 and the driver ICs 11 are connected as shown in FIGS. 3 and 6. In more detail, the FPC 5 is connected to end portion regions 21E positioned at one and the other end portions of the ground electrode wiring 21 on both end portion sides as shown in FIG. 6. The FPC 5 is also connected to an intermediate region 21M of the ground electrode wiring 21 positioned between adjacent driver ICs 11 on a center side.

The driver ICs 11 are arranged so as to correspond to the respective groups of the plurality of heat-generating portions 9 and are connected to one end portions of the individual electrode wirings 19 and the ground electrode wiring 21 as shown in FIG. 6. The drivers IC 11 are configured to control a conducting state of respective heat-generating portions 9, and well-known ones having a plurality of switching devices thereinside can be used, which become conductive when the respective switching devices are in an on-state and become non-conductive when respective switching devices are in an off-state. In each driver IC 11, as shown in FIG. 2, one connection terminals 11*a* connected to the internal switching devices (not shown) (hereinafter referred to as first connection terminals 11*a*) are connected to the individual electrode wirings 19, and the other connection terminals 11*b* connected to the switching devices (hereinafter referred to as second connection terminals 11*b*) are connected to the ground electrode wiring 21. Accordingly, when respective switching devices of the driver IC 11 are in the on-state, the individual electrode wirings 19 connected to the respective switching devices are electrically connected to the ground electrode wiring 21.

A plurality of the first connection terminals 11*a* and the second connection terminals 11*b* are provided so as to correspond to the respective individual electrode wirings 19, though not shown. The plurality of first connection terminals 11*a* are individually connected to the respective individual electrode wirings 19. The plurality of second connection terminals 11*b* are connected to the ground electrode wiring 21 in common.

The IC control wirings 23 are for controlling the driver ICs 11, having IC power wirings 23*a* and IC signal wirings 23*b* as shown in FIG. 5. The IC power wirings 23*a* include end-portion power wiring portions 23*a*E arranged in the vicinity of the right long side of the substrate 7 at both end portions in the longitudinal direction of the substrate 7 and intermediate power wiring portions 23*a*M arranged between adjacent driver ICs 11.

As shown in FIG. 5, the end-portion power wiring portion 23*a*E is arranged so that one end portion thereof is arranged at an arrangement region of the driver IC 11 and the other end portion thereof is arranged in the vicinity of the right long side of the substrate 7 in a manner of being drawn around the grand electrode wiring 21. The end-portion power wiring portion 23*a*E is arranged so that one end portion thereof is connected to the driver IC 11 and the other end portion thereof is connected to the FPC 5. Accordingly, the driver ICs 11 are electrically connected to the FPC 5.

As shown in FIG. 5, the intermediate power wiring portion 23*a*M extends along the ground electrode wiring 21, one end portion is arranged at an arrangement region of one of adjacent driver ICs 11 and the other end portion is arranged at an arrangement region of the other of adjacent driver ICs 11. The intermediate power wiring portion 23*a*M is arranged so that one end portion thereof is connected to one of adjacent driver ICs 11, the other end portion thereof is connected to the other of adjacent driver ICs 11, and an intermediate portion thereof is connected to the FPC 5 (refer to FIG. 3). Accordingly, the driver ICs 11 are electrically connected to the FPC 5.

The end-portion power wiring portion 23*a*E and the intermediate power wiring portion 23*a*M are electrically connected to each other inside the driver IC 11 to which both power wiring portions are connected. The adjacent intermediate power wiring portions 23*a*M are electrically connected to each other inside the driver IC 11 to which both wiring portions are connected.

As described above, the IC power wirings 23*a* electrically connect between respective driver ICs 11 and the FPC 5 by connecting the IC power wirings 23*a* to the respective driver ICs 11. Accordingly, electric current is supplied from the FPC 5 to the respective driver ICs 11 through the end-portion power wiring portions 23*a*E and the intermediate power wiring portions 23*a*M as described later.

The IC signal wirings 23*b* include end-portion signal wiring portions 23*b*E arranged in the vicinity of the right long side of the substrate 7 at both end portions in the longitudinal direction of the substrate 7 and intermediate signal wiring portions 23*b*M arranged between adjacent driver ICs 11 as shown in FIG. 5.

As shown in FIG. 5, the end-portion signal wiring portion 23*b*E is arranged so that one end portion thereof is arranged at the arrangement region of the driver IC 11 and the other end portion thereof is arranged in the vicinity of the right long side of the substrate 7 in a manner of being drawn around the grand electrode wiring 21 in the same manner as the end-portion power wiring portion 23*a*E. The end-portion signal wiring portion 23*b*E is arranged so that one end portion thereof is connected to the driver IC 11 and the other end portion thereof is connected to the FPC 5.

The intermediate signal wiring portion 23*b*M is arranged so that one end portion thereof is arranged at an arrangement region of one of adjacent driver ICs 11 and the other end portion thereof is arranged at an arrangement region of the other of adjacent driver ICs 11 in a manner of being drawn around the intermediate power wiring portion 23*a*M. The intermediate signal wiring portion 23*b*M is arranged so that one end portion thereof is connected to one of adjacent driver ICs 11 and the other end portion thereof is connected to the other of adjacent driver ICs 11.

The end-portion signal wiring portion 23*b*E and the intermediate signal wiring portion 23*b*M are electrically connected to each other inside the driver IC 11 to which both wiring portions are connected. The adjacent intermediate signal wiring portions 23*b*M are electrically connected to each other inside the driver IC to which both wiring portions are connected.

As described above, the IC signal wirings 23*b* electrically connect between the respective driver ICs 11 and the FPC 5 by connecting the IC signal wirings 23*b* to the respective driver ICs 11. Accordingly, a control signal transmitted from the FPC 5 to the driver IC 11 through the end-portion signal wiring portion 23*b*E is further transmitted to the adjacent driver IC 11 through the intermediate signal wiring portion 23*b*M as described later.

The above-described electric resistor layer 15, the common electrode wiring 17, the individual electrode wirings 19, the ground electrode wiring 21 and IC control wirings 23 are formed by, for example, sequentially stacking material layers forming respective components on the thermal storage layer 13 by using, for example, a well-known thin-film forming technique such as sputtering, then, processing a stacked body into a given pattern by using a well-known photolithography technique, an etching technique or the like.

As shown in FIGS. 2 and 3, the first covering layer 24 covering part of the heat-generating portions 9, the common electrode wiring 17 and part of the individual electrode wirings 19 is disposed above the thermal storage layer 13 formed on the upper surface of the substrate 7. In the shown example, the first covering layer 24 is disposed so as to cover the approximately left half of the upper surface of the thermal storage layer 13, and the left end of the first covering layer 24 extends to the end of the thermal storage layer 13. The first covering layer 24 is formed on the heat-generating portions 9, the common electrode wiring 17 and the individual electrode wirings 19 as well as extends from atop the heat-generating portions 9, the common electrode wiring 17 and the individual electrode wirings 19 as seen from a direction orthogonal to one main surface of the substrate 7 toward atop the thermal storage layer 13 on the edge 7*a* of the substrate 7. In more detail, the first covering layer 24 extends from atop the main wiring portion 17*a* of the common electrode wiring 17 further toward atop the thermal storage layer 13 on the edge 7*a* of the substrate 7, on the thermal storage layer 13.

The first covering layer 24 is configured to suppress covered portions of the heat-generating portions 9, the common electrode wiring 17 and the individual electrode wirings 19 to be oxidized due to reaction with oxygen or to be corroded due to adhesion of moisture or the like included in the air. The first covering layer 24 is made of a material having a high Vickers hardness value than the thermal storage layer 13, which can be made by materials such as SiN, SiC or SiON. These materials can include other elements such as Al. A Vickers hardness of SiN is approximately 1600 to 1800 HV, a Vickers hardness of SiC is approximately 2000 to 2200 HV and a Vickers hardness of SiON is approximately 1200 to 1400 HV. The first covering layer 24 can be formed by using a well-known thin-film forming technique or the like such as sputtering or vapor deposition. The first covering layer 24 can be formed by stacking a plurality of material layers.

Figure 7:
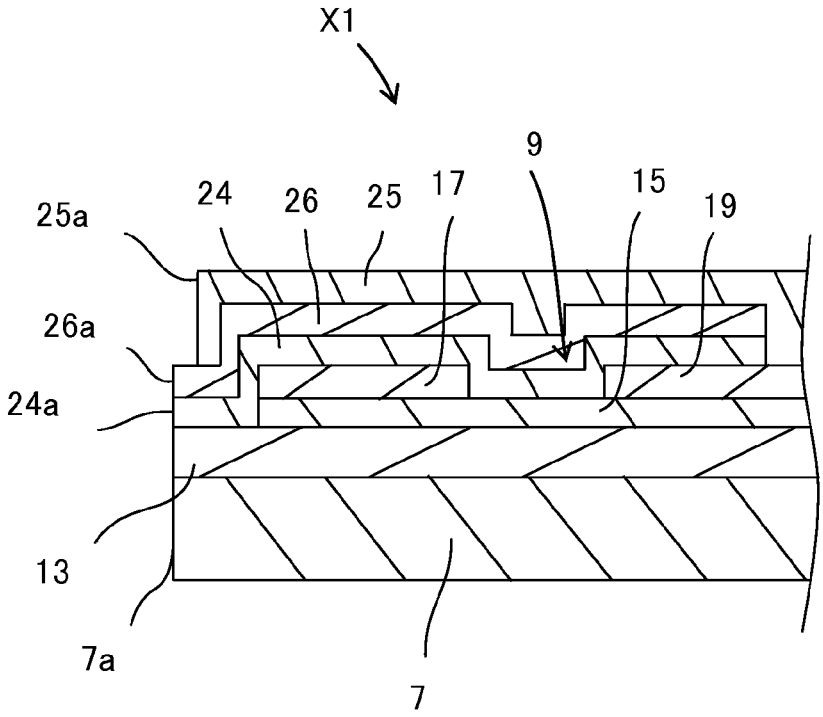
FIG. 7 is a partially-enlarged view showing a modified example of the thermal head according to one embodiment of the invention in a cross section of the thermal head shown in FIG. 2.

As shown in FIG. 7, a second covering layer 26 may be disposed on the first covering layer 24. The second covering layer 26 is preferably made of a material different from the first covering layer 24, for example, can be made of materials such as SiN, SiC or SiON. When the second covering layer 26 made of a different material is disposed on the first covering layer 24 as described above, the possibility that the heat-generating portions 9, the common electrode wiring 17 and the individual electrode wirings 19 are oxidized can be further reduced.

The second covering layer 26 is disposed on the first covering layer 24, and an edge 26*a* of the second covering layer 26 can be disposed on an edge 24*a* of the first covering layer 24. Accordingly, the possibility that the heat-generating portions 9, the common electrode wiring 17 and the individual electrode wirings 19 are oxidized can be much further reduced.

The second covering layer 26 preferably has a higher Vickers hardness than the first covering layer 24. For example, the first covering layer 24 is made of SiN having the Vickers hardness of approximately 1600 to 1800 HV and the second covering layer 26 is made of SiC having the Vickers hardness of approximately 2000 to 2200 HV, thereby improving abrasion resistance of the second covering layer 26 making contact with a recording medium and obtaining the first covering layer 24 and the second covering layer 26 in which oxidation resistance and abrasion resistance have been improved.

It is also preferable that the second covering layer 26 is made of a material having a lower Vickers hardness than that of the first covering layer 24. For example, the first covering layer 24 is made of SiN having the Vickers hardness of approximately 1600 to 1800 HV and the second covering layer 26 is made of SiON having the Vickers hardness of approximately 1200 to 1400 HV or $SiO_2$ having a Vickers hardness of 600 to 800 HV, thereby alleviating stress by the second covering layer 26 and reducing the possibility that a chip or a crack occurs in the first covering layer 24 and the second covering layer 26 even when large stress is generated in the first covering layer 24 and the second covering layer 26 at the time of separating the thermal head X1 from a mother board, which will be described later in detail.

In particular, when the second covering layer 26 is made of $SiO_2$ having the Vickers hardness of 600 to 800 HV which is softer than the first covering layer 24, adhesiveness with respect to the first protection film 25 can be increased as well as stress generating at the time of separating the substrate is alleviated to thereby obtain the thermal head X1 in which the possibility that a chip or a crack occurs is reduced in the case where the first covering layer 24 is made of SiN having the Vickers hardness of 1600 to 1800 HV. It is not always necessary that the edge of the second covering layer 26 is disposed above the edge 7*a* of the substrate 7, and it is preferable that the edge of the second covering layer 26 is disposed between the edge 7*a* of the substrate 7 and the edge 25*a* of the first protection film 25. Accordingly, the possibility that a crack occurs in the second covering layer 26 can be reduced.

As shown in FIGS. 1 to 4, the first protection film 25 is disposed on or above the first covering layer 24. The first protection film 25 is disposed so as to cover the first covering layer 24 except a region in the vicinity of the edge 24*a* on the left side of the first covering layer 24 in the shown example. That is, the first covering layer 24 is not disposed above the edge 7*a* of the substrate 7. In other words, the first protection film 25 is disposed on or above the first covering layer 24, and the edge 25*a* of the first protection film 25 is disposed apart from the edge 7*a* of the substrate 7.

The first protection film 25 is disposed on or above the first covering layer 24 over the heat-generating portions 9, the common electrode wiring 17 and the individual electrode wirings 19 as seen from a direction orthogonal to the upper surface of the substrate 7. The edge 25*a* of the first protection film 25 extends on the first covering layer 24 so as to be positioned between the heat-generating portions 9, the common electrode wiring 17 and the individual electrode wirings 19, and the edge 7*a* of the substrate 7. In more detail, the first protection film 25 extends on the first covering layer 24 so that the edge 25*a* of the first protection film 25 is positioned between the main wiring portion 17*a* of the common electric wiring 17 and the edge 7*a* of the substrate 7. In the present embodiment, the first protection film 25 corresponds to the protection film in the invention.

As the first protection film 25 is not disposed above the edge 7*a* of the substrate 7 which is liable to make contact with the outside as described above, the possibility that a crack occurs in the first protection film 25 can be reduced. Accordingly, the heat-generating portions 9, the common electrode wiring 17 and the individual electrode wirings 19 can be sealed with the first protection film 25 even when the crack occurs in the thermal storage layer 13. As a result, the corrosion and deterioration of the heat-generating portions 9, the common electrode wiring 17 and the individual electrode wirings 19 can be reduced.

Here, when the above thermal head is manufactured, there is a case, in general, where the thermal storage layers, electrode wirings, the heat-generating resistors, the protection films or the like to be a plurality of thermal heads are formed at a time on a large mother board from which a plurality of substrates each for forming one thermal head can be taken. When the device is manufactured in the above manner, the thermal storage layer included in the respective thermal heads is formed so as to extend over a plurality of substrates forming a plurality of thermal heads. Accordingly, the thermal storage layer exists on dividing lines of the mother board, namely, on edges of substrates in the respective thermal heads. In such case, a crack may occur in the thermal storage layer arranged on edges of divided substrates when the mother board is divided. Since the crack extends due to thermal response at the time of driving the thermal head, there is a possibility that corrosion or deterioration of the heat-generating resistors 9 occurs when a crack connecting through an upper surface and a lower surface of the thermal storage layer 13 occurs.

In response to the above, the first covering layer 24 extends from atop the main wiring portion 17*a* of the common electric wiring 17 toward atop the thermal storage layer 13 on the edge 7*a* of the substrate 7 as seen from the direction orthogonal to the upper surface of the substrate 7, therefore, the thermal storage layer 13 on the edge 7*a* of the substrate 7 to be a dividing line is covered by the first covering layer 24, for example, even when the edge 7*a* of the substrate 7 is the dividing line of the mother board as in the related art example. Accordingly, it is possible to reduce the occurrence of a chip or a crack on the thermal storage layer 13 made of glass on the edge 7*a* of the divided substrate 7 in the case where the mother board is divided as in the related art example.

Furthermore, the occurrence of a crack in the thermal storage layer 13 can be reduced by the first covering layer 24 provided for suppressing oxidation of the heat-generating portions 9, the common electrode wiring 17 and the individual electrode wirings 19, therefore, the structure of the thermal head X1 can be simplified.

The first protection film 25 is configured to protect the heat-generating portions 9, the common electrode wiring 17 and the individual electrode wirings 19 from the abrasion due to the contact to the recording medium to be printed. The first protection film 25 can be made of materials such as glass containing $SiO_2$, $Bi_2O_3$ and ZnO, glass containing $SiO_2$, $B_2O_3$ and PbO, glass containing $SiO_2$, PbO and ZnO, glass containing $SiO_2$, $B_2O_3$ and RO and glass containing $SiO_2$, ZnO and RO or materials such as SiN, SiC or SiON. When the first protection film is made of glass, the Vickers hardness will be 300 to 600 HV.

The first protection film 25 can also be formed by using, for example, a thick-film forming technique such as screen printing, a well-known thin-film forming technique such as sputtering or deposition. In the case where the first protection film 25 is formed by the thick-film forming such as screen printing, a film defect can be filled by the first protection film 25 even when the film defect occurs in a portion of the first covering layer 24 covered by the first protection film 25. The first protection film 25 may be formed by stacking a plurality of material layers.

In the thermal head X1 according to the present embodiment, when the thermal storage layer 13 and the first covering layer 24 disposed above the edge 7*a* of the substrate 7 provided at corner portions which are liable to collide with exterior components unexpectedly touch a casing of a thermal printer or the like and thus a crack occurs in the thermal storage layer 13 and the first covering layer 24, for example, in the case where the thermal head X1 is assembled to a body of the thermal printer, the possibility of crack extension can be reduced as the first protection film 25 is not disposed above the edge 7*a* of the substrate.

As described above, the first protection 25 is not disposed above the edge 7*a* of the substrate 7 to be the dividing line of the mother board. In other words, the possibility that a crack occurs in the first protection film 25 can be reduced even when the substrate 7 is divided at the edge 7*a*, because the first protection film 25 is disposed apart from the edge 7*a* of the substrate 7 which is the dividing line. Accordingly, it is possible to reduce the extension of the crack occurring in the thermal storage layer 13 at the same time as the crack occurring in the first protection film 25 extends.

Additionally, as shown in FIGS. 1 to 4, the first protection film 25 is disposed on or above the first covering layer 24 so that the edge 25*a* of the first protection film 25 is positioned between the main wiring portion 17*a* of the common electrode wiring 17 and the edge 7*a* of the substrate 7 as seen from the direction orthogonal to the upper surface of the substrate 7. Accordingly, since the first protection film 25 is disposed apart from the edge 7*a* of the substrate 7 to be the dividing line at the time of dividing the mother board as in the related art example, it is possible to reduce the crack extension by the first protection film 25 disposed apart from the edge 7*a* of the substrate 7 even when the crack occurs in the glass-made thermal storage layer 13 disposed on the edge 7*a* of the substrate 7 as well as in the first covering layer 24 when the mother board is divided.

Furthermore, as the first protection film 25 is not disposed on dividing lines of the mother board, the mother board can be divided while checking the dividing lines. Accordingly, the dividing accuracy in a dividing process of the substrate can be improved.

Moreover, it is preferable that the first protection film 25 has a lower Vickers hardness than that of the thermal storage layer 13. As an exemplification, the first protection film 25 can be made of Pb-based glass or Bi-based glass. Since the first protection film 25 has a lower Vickers hardness than that of the thermal storage layer 13 as described above, the extension of a chip or a crack can be suppressed by the soft first protection film 25 even when the crack occurs in the thermal storage layer 13 and the first covering layer 24.

Though the example in which the edge 25*a* of the first protection film 25 is vertically provided has been shown in the thermal head X1, the invention is not limited to this. It is also preferable that, for example, the edge 25*a* has a tapered shape gradually sloping toward the edge 7*a* of the substrate 7.

As shown in FIGS. 1 to 4, the second protection film 28 partially covering the common electrode wiring 17, the individual electrode wirings 19, the IC control wirings 23 and the ground electrode wiring 21, is disposed above the thermal storage layer 13 formed on the upper surface of the substrate 7. In the shown example, the second protection film 28 is disposed so as to partially cover a region of approximately the right half of the upper surface of the thermal storage layer 13. The second protection film 28 is configured to protect the covered common electrode wiring 17, the individual electrode wirings 19, the IC control wirings 23 and the ground electrode wiring 21 from oxidation due to contact with the air and corrosion due to adhesion of moisture or the like included in the air. The second protection film 28 is disposed so as to overlap with an end portion of the first protection film 25 for securing the protection of the common electrode wiring 17, the individual electrode wirings 19 and the IC control wirings 23. The second protection film 28 can be made of, for example, resin materials such as epoxy resin and polyimide resin. Additionally, the second protection film 28 can be formed by using the thick-film forming technique such as screen printing.

Additionally, openings (not shown) for exposing end portions of the individual electrode wirings 19 connecting the driver ICs 11, an second intermediate region 21N and a third intermediate region 21L of the ground electrode wiring 21 and end portions of the IC control wirings 23 are formed in the second protection film 28, and these wirings are connected to the driver ICs 11 through the openings. The driver ICs 11 are sealed by being covered with a covering member 29 made of resin such as epoxy resin or silicone resin for protecting the driver ICs 11 themselves and connecting portions between the driver ICs 11 and these wirings in a state of being connected to the individual electrode wirings 19, the ground electrode wiring 21 and the IC control wirings 23.

As shown in FIG. 6, the FPC 5 is connected to the common electrode wiring 17, the ground electrode wiring 21 and IC control wirings 23 as described above. As the FPC 5, a well-known board in which a plurality of printed wirings are arranged inside an insulating resin layer can be used, in which respective printed wirings are electrically connected to an external power supply device, a controller and the like, which are not shown, through a connector 31 (refer to FIGS. 1 and 6).

In more detail, in the FPC 5, the respective printed wirings disposed thereinside are connected to end portions of the two sub-wiring portions 17*b* of the common electric wiring 17, end portions of the ground electrode wiring 21 and end portions of the IC control wirings 23 to thereby connect between these wirings 17, 21 and 23 and the connector 31 by solder bumps 33 (refer to FIG. 3). Then, when the connector 31 is electrically connected to the external power supply device, the controller and the like (not shown), the common electrode wiring 17 is connected to a positive-side terminal of the power supply device held in a positive potential of 20 to 24 V and the individual electrode wirings 19 are electrically connected to a negative-side terminal of the power supply device held in a ground potential of 0 to 1 V. Accordingly, electric current is supplied to the heat-generating portions 9 when the switching devices of the driver ICs 11 are in the on-state, and the heat-generating portions 9 generate heat.

Moreover, when the connector 31 is electrically connected to the external power supply device, the controller and the like (not shown), the IC power wirings 23*a* of the IC control wirings 23 are connected to the positive-side terminal of the power supply device held in the positive potential in the same manner as the common electrode wiring 17. Accordingly, electric current for operating the driver ICs 11 is supplied to the driver ICs 11 by the difference of potentials in the IC power wirings 23*a* to which the driver ICs 11 are connected and the ground electrode wiring 21. The IC signal wirings 23*b* of the IC control wirings 23 are connected to the controller performing control of the driver ICs 11. Accordingly, a control signal from the controller is transmitted to the driver IC 11 through the end-portion signal wiring portion 23*b*E, and the control signal transmitted to the driver IC 11 is further transmitted to the adjacent driver IC through the intermediate signal wiring portion 23*b*M. The on/off states of the switching devices inside the drivers IC 11 are controlled by the control signal, thereby allowing the heat-generating portions 9 to generate heat selectively.

Hereinafter, a manufacturing method of the thermal head X1 will be described.

The manufacturing method of the thermal head X1 includes a process of forming the thermal storage layer 13 over the entire surface of the mother board, a process of forming the electric resistor layer 15 over the entire surface of the thermal storage layer 13, and a process of forming a conductive layer (not shown) to be various types of electrodes such as the common electrode wiring 17 over the entire surface of the electric resistor layer 15. The manufacturing method further includes a process of patterning the electric resistor layer 15 and the conductive layer, a process of forming the first covering layer on the conductive layer other than a portion to be connected to the FPC 5, and a process of forming the first protection film 25 in a given position and firing the film. The first protection film 25 is not disposed on the dividing lines of the mother board. Then, the second protection film 28 is formed in a given position and the mother board is divided along the dividing lines, thereby fabricating the thermal head X1. The process of forming respective component members, the process of performing patterning and the process of dividing can be performed by using any methods generally known in the thin-film or thick-film forming techniques.

The given position where the first protection film 25 is formed differs according to the number of thermal heads X1 to be divided from the mother board. Hereinafter, a case where two thermal heads X1 are divided from the mother board will be described as an example.

When two thermal heads X1 are divided from the mother board, various electrode wirings such as the common electrode wiring are patterned so as to be mirror images to each other with respect to the central line of the mother board. That is, various members are formed by performing patterning so that the dividing line of the substrates 7 will be the central line of the mother board.

Then, the first protection film 25 is formed between the heat-generating portions 9 and the dividing line of the substrates 7. Accordingly, the first protection films 25 which are parallel to each other may be formed to indicate the dividing line of the substrates 7.

As described above, the thermal storage layer 13 and the first covering layer 24 are disposed and the first protection film 25 is not disposed on the dividing line of the substrate 7, and therefore the first covering layer 24 can reduce the possibility that a crack occurring in the thermal storage layer 13 extends even when the substrate 7 is divided at the dividing line. Moreover, as the first protection film 25 is not disposed on the dividing line of the substrate 7, the possibility that a crack occurs in the first protection film 25 can be suppressed.

Figure 8:
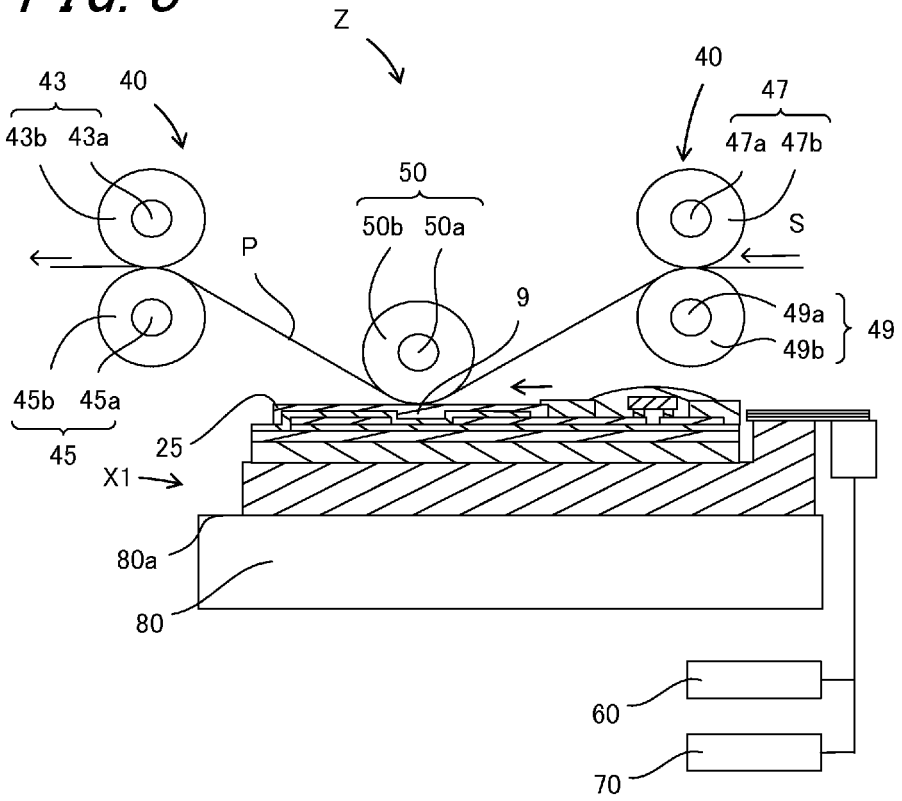
FIG. 8 is a schematic view showing an outline of a thermal printer according to one embodiment of the invention.

Next, a thermal printer according to an embodiment of the invention will be described with reference to FIG. 8. FIG. 8 is a schematic structure view of a thermal printer Z according to the present embodiment.

As shown in FIG. 8, the thermal printer Z according to the present embodiment includes the above-described thermal head X1, a conveyance mechanism 40, a platen roller 50, a power supply device 60 and a controller 70. The thermal head X1 is attached to an attachment surface 80*a* of an attachment member 80 provided in a casing (not shown) of the thermal printer Z. The thermal head X1 is attached to the attachment member 80 so that the arrangement direction of the heat-generating elements 9 is along a direction (a main scanning direction) orthogonal to a conveying direction S of a later-described recording medium P, namely, a direction orthogonal to a plane of paper of FIG. 8.

The conveyance mechanism 40 is configured to convey the recording medium P such as heat-sensitive paper or receiver paper on which ink is transferred in a direction of an arrow S in FIG. 8 to be conveyed on a plurality of heat-generating elements 9 of the thermal head X1, having conveyance rollers 43, 45, 47 and 49. The conveyance rollers 43, 45, 47 and 49 can be formed by, for example, coating cylindrical shafts 43*a*, 45*a*, 47*a* and 49*a* made of a metal such as stainless steel with elastic members 43*b*, 45*b*, 47*b* and 49*b* made of butadiene rubber or the like. When the recording medium P is the receiver paper on which ink is transferred, an ink film is conveyed together with the recording medium P between the recording medium P and the heat-generating elements 9 of the thermal head X1, though not shown.

The platen roller 50 is configured to press the recording medium P on the heat-generating elements 9 of the thermal head X1, which is arranged so as to extend along a direction orthogonal to the conveying direction S of the recording medium P, both end portions of which are supported so as to be rotated in a state of pressing the recording medium P on the heat-generating elements 9. The platen roller 50 can be formed by, for example, coating a cylindrical shaft 50*a* made of a metal such as stainless steel with an elastic member 50*b* made of butadiene rubber or the like.

The power supply device 60 is configured to apply a voltage for allowing the heat-generating elements 9 of the thermal head X1 to generate heat and a voltage for operating the driver ICs 11 as described above. The controller 70 is configured to supply a control signal controlling the operation of the driver ICs 11 to the driver ICs 11 for allowing the heat-generating elements 9 of the thermal head X1 to generate heat selectively as described above.

The thermal printer Z according to the present embodiment can perform given printing on the recording medium P by allowing the heat-generating elements 9 to generate heat selectively by the power supply device 60 and the controller 70 while pressing the recording medium on the heat-generating elements 9 of the thermal head X1 by the platen roller 50 and conveying the recording medium P on the heat-generating elements 9 by the conveyance mechanism 40 as shown in FIG. 8. When the recording medium P is the receiver paper or the like, the printing on the recording medium P can be performed by thermally transferring ink of the ink film (not shown) conveyed together with the receiving medium P on the recording medium P.

Figure 9:
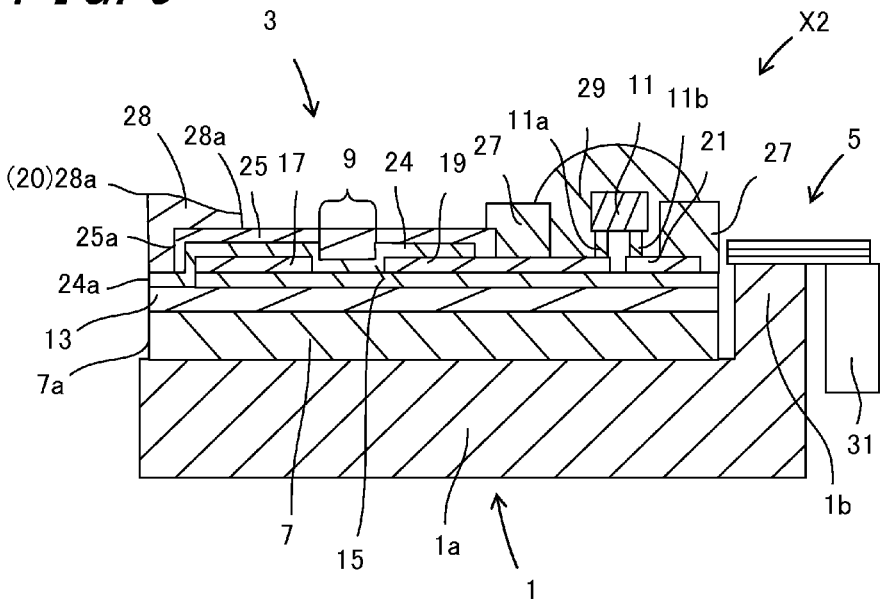
FIG. 9 is a cross-sectional view in a thermal head according to another embodiment of the invention, which corresponds to FIG. 2.
Figure 10:
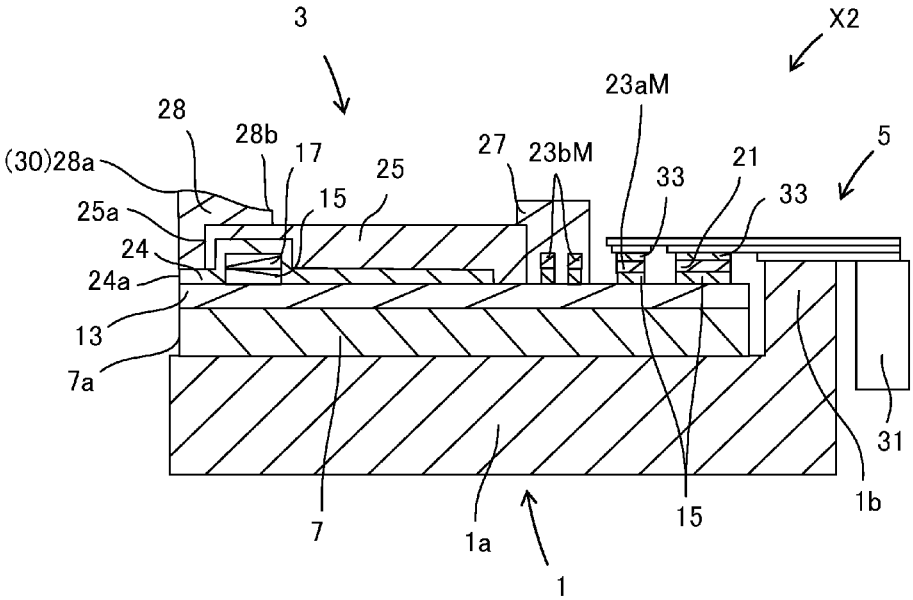
FIG. 10 is a cross-sectional view in a thermal head according to another embodiment of the invention, which corresponds to FIG. 3.

A thermal head X2 according to a second embodiment will be described with reference to FIGS. 9 and 10. FIGS. 9 and 10 are views respectively corresponding to FIGS. 2 and 3, and a plan view of the thermal head X2 is not shown.

The thermal head X2 has the second protection film 28 as a resin layer extending from the edge 7*a* of the substrate 7 onto the first protection film 25. Other portions are the same as those of the thermal head X1, and description thereof is omitted.

In the second protection film 28 disposed above the edge 7*a* of the substrate 7, one end portion 28*b* thereof is disposed on the first protection film 25, and the other end portion 28*a* thereof is disposed above the edge 7*a* of the substrate 7. Then, a convex portion 30 higher than other portions is disposed on the edge 7*a* side of the substrate 7. As shown in FIGS. 9 and 10, the convex portion 30 is formed in the other end portion 28*a* of the second protection film 28.

The convex portion 30 of the second protection film 28 is located at a higher position than other portions of the second protection film 28. Accordingly, the recording medium, particularly, an ink ribbon having passed on the heat-generating portions 9 is pushed toward a separating direction due to the presence of the convex portion 30 of the second protection film 28. As a result, the separation between the thermal head X2 and the ink ribbon can be smoothly performed. Accordingly, the thermal head X2 capable of performing printing at high speed can be obtained.

As the second protection film 28 is made of soft resin and is disposed above the edge 7*a* of the substrate 7, the second protection film 28 disposed on the edge 25*a* of the first protection film 25 can alleviate stress even when the stress generated by the crack extension occurring in the thermal storage layer 13 occurs in the first protection film 25. Accordingly, the possibility that the first protection film 25 separates from the first covering layer 24 can be reduced.

Note that the convex portion 30 of the second protection film 28 is disposed above the edge 7*a* of the substrate 7. Accordingly, the separation between the thermal head X2 and the ink ribbon can be performed more smoothly.

Hereinafter, a method of forming the second protection film 28 will be described.

The first protection film 25 is formed above the mother board in the same method as the thermal head X1. After that, as shown in FIGS. 9 and 10, the second protection film 28 is formed on the dividing line and on the side connected to the FPC 5. As a method of forming the convex portion 30 of the second protection film 28, for example, it is possible to form the convex portion 30 by coating the other end portion 28*a* with a resin material plural times as well as by coating the second protection film 28 from the other end portion 28*a* side by using a resin having high viscosity.

One embodiment of the invention has been described as the above, however, the invention is not limited to the above embodiment and various modifications are possible without departing from the scope of the invention.

Figure 11:
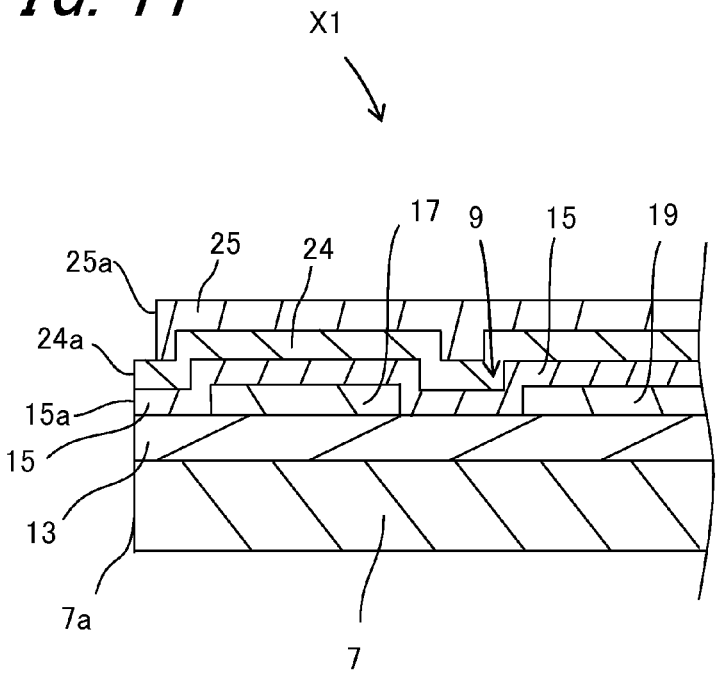
FIG. 11 is a partially enlarged view showing a modified example of a thermal head according to another embodiment of the invention in the cross section shown in FIG. 2.

For example, though the common electrode wiring 17 and the individual electrode wirings 19 are formed on the electric resistor layer 15 in the thermal head X1 according to the above embodiment as shown in FIG. 2, the invention is not limited to this as long as both the common electrode wiring 17 and the individual electrode wirings 19 are connected to the electric resistors to be the heat-generating portions. For example, it is also preferable that the common electrode wiring 17 and the individual electrode wirings 19 are formed on the thermal storage layer 13, then, the electric resistor layer 15 is formed on the thermal storage layer 13 on which the common electrode wiring 17 and the individual electrode wirings 19 are formed as shown FIG. 11. In this case, regions on the electrode resistor layer 15 positioned between the common electrode wiring 17 and the individual electrode wirings 19 will be electric resistors in the invention, and the regions form the heat-generating portions 9.

Figure 12:
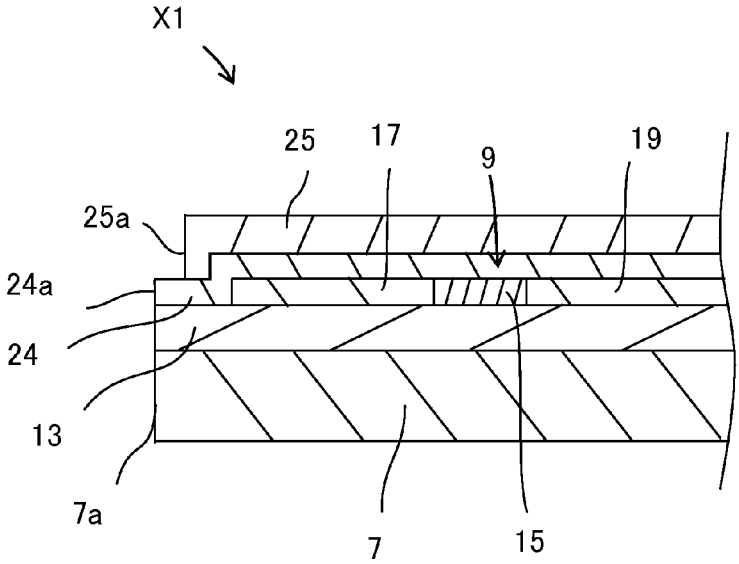
FIG. 12 is a partially-enlarged view showing a modified example of a thermal head according to another embodiment of the invention in the cross section shown in FIG. 2.

It is further preferable that the common electrode wiring 17 and the individual electrode wirings 19 are formed on the thermal storage layer 13, and the electric resistor layer 15 is formed only in regions between the common electrode wiring 17 and the individual electrode wirings 19 as shown in FIG. 12. In this case, the electric resistor layer 15 will be the electric resistors in the invention, and the electric resistor layer 15 form the heat-generating portions 9.

REFERENCE SIGNS LIST

X1, X2: Thermal head
1: Heatsink
3: Head base
7: Substrate
7*a*: Edge of Substrate
9: Heat-generating portion
13: Thermal storage layer
15: Electric resistor layer
17: Common electrode wiring
19: Individual electrode wiring
24: First covering layer
24*a*: Edge of First covering layer
25: First protection film
25*a*: Edge of First protection film
26: Second covering layer
26*a*: Edge of Second covering layer
28: Second protection film
28*a*: Other end portion of Second protection film
28*b*: One end portion of Second protection film
30: Convex portion of Second protection film

The invention claimed is:

1. A thermal head, comprising:

a substrate;

a thermal storage layer disposed on one main surface of the substrate so as to extend to an edge of the substrate, the thermal storage layer being formed of glass;

electrodes disposed on or above the thermal storage layer apart from the edge of the substrate;

heat-generating resistors disposed above the thermal storage layer apart from the edge of the substrate, the heat-generating resistors being connected to the electrodes; and a first covering layer disposed on or above the electrodes and the heat-generating resistors so as to extend from atop the electrodes and the heat-generating resistors toward atop the thermal storage layer on the edge of the substrate; and a protection film disposed on or above the first covering layer disposed on or above the electrodes and the heat-generating resistors, an edge of the protection film being not disposed above the edge of the substrate, and being positioned between the electrodes and the edge of the substrate.

2. The thermal head according to claim 1, wherein the first covering layer has a higher Vickers hardness than that of the thermal storage layer.

3. The thermal head according to claim 1, wherein the protection film has a lower Vickers hardness than that of the thermal storage layer.

4. The thermal head according to claim 1, comprising:

a second covering layer disposed between the first covering layer and the protection film.

5. The thermal head according to claim 4, wherein the second covering layer is made of SiON.

6. The thermal head according to claim 1, wherein the first covering layer is made of SiN.

7. The thermal head according to claim 4, wherein the second covering layer is made of $SiO_2$.

8. The thermal head according to claim 1, comprising:

a resin layer disposed above a region extending from the edge of the substrate to the protection film, a portion of the resin layer positioned above the edge of the substrate being disposed higher than a portion of the resin layer positioned above the protection film.

9. A thermal printer, comprising:

the thermal head according to claim 1;

a conveyance mechanism that conveys a recording medium on a plurality of heat-generating portions; and a platen roller that presses the recording medium on the plurality of heat-generating portions.

10. A thermal head, comprising:

a substrate;

a thermal storage layer disposed on one main surface of the substrate so as to extend to an edge of the substrate, the thermal storage layer being formed of glass;

electrodes disposed on or above the thermal storage layer apart from the edge of the substrate;

heat-generating resistors disposed above the thermal storage layer apart from the edge of the substrate, the heat-generating resistors being connected to the electrodes; and a first covering layer disposed on or above the electrodes and the heat-generating resistors so as to extend from atop the electrodes and the heat-generating resistors toward atop the thermal storage layer on the edge of the substrate;

a protection film disposed on or above the first covering layer disposed on or above the electrodes and the heat-generating resistors, an edge of the protection film being not disposed above the edge of the substrate; and a second covering layer disposed between the first covering layer and the protection film.

11. The thermal head according to claim 10, wherein the first covering layer is made of SiN.

12. The thermal head according to claim 10, wherein the second covering layer is made of SiON.

13. The thermal head according to claim 10, wherein the second covering layer is made of $SiO_2$.

14. The thermal head according to claim 10, comprising:

a resin layer disposed above a region extending from the edge of the substrate to the protection film, a portion of the resin layer positioned above the edge of the substrate being disposed higher than a portion of the resin layer positioned above the protection film.

15. A thermal printer, comprising:

the thermal head according to claim 10;

a conveyance mechanism that conveys a recording medium on a plurality of heat-generating portions; and a platen roller that presses the recording medium on the plurality of heat-generating portions.

16. A thermal head, comprising:

a substrate;

a thermal storage layer disposed on one main surface of the substrate so as to extend to an edge of the substrate, the thermal storage layer being formed of glass;

electrodes disposed on or above the thermal storage layer apart from the edge of the substrate;

heat-generating resistors disposed above the thermal storage layer apart from the edge of the substrate, the heat-generating resistors being connected to the electrodes; and a first covering layer disposed on or above the electrodes and the heat-generating resistors so as to extend from atop the electrodes and the heat-generating resistors toward atop the thermal storage layer on the edge of the substrate;

a protection film disposed on or above the first covering layer disposed on or above the electrodes and the heat-generating resistors, an edge of the protection film being not disposed above the edge of the substrate; and a resin layer disposed above a region extending from the edge of the substrate to the protection film, a portion of the resin layer positioned above the edge of the substrate being disposed higher than a portion of the resin layer positioned above the protection film.

17. The thermal head according to claim 16, wherein the first covering layer has a higher Vickers hardness than that of the thermal storage layer.

18. The thermal head according to claim 16, wherein the protection film has a lower Vickers hardness than that of the thermal storage layer.

19. The thermal head according to claim 16, wherein the first covering layer is made of SiN.

20. A thermal printer, comprising:

the thermal head according to claim 16;

a conveyance mechanism that conveys a recording medium on a plurality of heat-generating portions; and a platen roller that presses the recording medium on the plurality of heat-generating portions.

* * * * *